United States Patent [19]

Geraci

[11] 4,139,029

[45] Feb. 13, 1979

[54] ICE BAGGING DEVICE

[76] Inventor: James S. Geraci, 817 S. Fuller, Independence, Mo. 64052

[21] Appl. No.: 848,870

[22] Filed: Nov. 7, 1977

[51] Int. Cl.[2] ..... B65B 67/04; B65B 67/12

[52] U.S. Cl. ..... 141/98; 53/390; 53/572; 141/313; 141/391; 248/99

[58] Field of Search ..... 53/189, 384, 385, 390; 141/98, 10, 108, 114, 313, 314, 391; 248/95, 97, 99, 100, 101

[56] References Cited

U.S. PATENT DOCUMENTS

| | | | |
|---|---|---|---|
| 118,051 | 8/1871 | Price | 141/98 |
| 611,347 | 9/1898 | Biery | 248/97 |
| 1,432,486 | 10/1922 | Morris | 248/99 X |
| 1,571,608 | 2/1926 | Stillman | 248/95 X |
| 1,725,345 | 8/1929 | Donnellan | 141/314 |
| 1,765,346 | 6/1930 | Rosenfeld | 141/314 |
| 2,425,260 | 8/1947 | Mayer | 248/95 |
| 3,468,100 | 9/1969 | Rubel | 53/189 |
| 3,727,374 | 4/1973 | Williams | 53/189 |
| 3,889,449 | 6/1975 | Membrino | 53/189 |

*Primary Examiner*—Robert Louis Spruill

*Attorney, Agent, or Firm*—Fishburn, Gold & Litman

[57] ABSTRACT

A manual ice bagging device comprises a hopper having an inlet end for receiving aggregate ice therethrough, and an outlet end for directing the ice into a commensurately shaped bag. A stand is connected with the hopper and supports the same above a floor surface, and a bag support member is operably connected with the stand and is positioned directly below the outlet end of the hopper for abuttingly supporting the bottom of each bag during filling. A bag retaining clip is connected with the hopper and is shaped for detachably suspending a plurality of the bags therefrom and positioning the bags adjacent the hopper outlet end for sequentially unfolding the bags into an open, material receiving position about the hopper outlet end for individually filling each bag in a sanitary manner.

11 Claims, 7 Drawing Figures

ICE BAGGING DEVICE

This invention relates to manual bagging devices and in particular, to bagging devices having means for retaining and sequentially dispensing a plurality of bags adjacent a hopper portion for efficiently directing material into bags in a sanitary fashion.

Various types of bagging holders and devices are known and used, for example, in food, chemical, or other packing operations. These devices are often complex and are typically designed for fully automatic, high-speed operations.

The present invention seeks to provide a relatively inexpensive, lightweight, easily-cleaned and maintenance-free bagging device particularly adapted for bagging aggregate ice, such as cubes, chips, crushed ice, and the like. The bagging device includes a hopper having a smooth, crevice-free interior surface for contacting the ice and directing the same into a bag. Accordingly, the smooth interior surface is without areas for bacteria, germs, mold, dirt, or the like to lodge or develop, and thereby facilitates proper sanitation.

The present invention is particularly suitable for retail store operations selling bagged aggregate ice to the public for use in coolers, ice chests or similar refrigeration devices or for use during festive occasions where relatively large quantities of ice are consumed. Presently, these stores typically have an ice making machine, and the ice is manually packaged by holding the bag open with one hand and scooping in ice with the other using a conventional material scoop. Such a method is often awkward as the bag easily collapses before a substantial amount of ice can be put therein. The top of the bag must therefore be opened with the tip of the scoop during every filling stroke, or a second operator is required to hold the bag open. These bagging methods requires extensive manual handling of the ice and bags, and the same can easily become contaminated by dirt, germs, bacteria or other foreign or disease-producing substances. Since the ice bagging duties are typically performed by personnel who perform other, less cleanly tasks, such as shelf stocking, floor sweeping, and the like it is impracticable to maintain sufficiently sanitary conditions during the bagging operation. Government regulatory agencies have begun to recognize the hazard of this possibility of contamination and movement are underway to define ice as an edible substance and to place ice-bagging operations under the supervision of these food inspection agencies.

The principal objects of the present invention are: to provide a manual ice bagging device having means for bagging materials in a sanitary fashion; to provide such a device having means for retaining a plurality of bags and dispensing the same to a ready position for fast and efficient bagging operations; to provide such a device for receiving a bag to be filled and positioning the same under a material directing hopper for one-man bagging; to provide such a device for supporting various sizes of bags to be filled; to provide such a device including a material directing hopper having a smooth, crevice-free interior surface for facilitating sanitary precautions; to provide such a device wherein the hopper includes a lid for closing the hopper when not in use and protecting the same from the intrusion of dirty or disease-producing foreign matter; to provide such a device wherein the lid has stop member for holding the lid in an open position at an angle to the hopper for directing materials therein; to provide such a device which is lightweight and mobile for ease of use and shipping; and to provide such a device which is relatively inexpensive, highly durable and reliable in use and well adapted for its intended purpose.

Other objects and advantages of this invention will become apparent from the following description taken in connection with the accompanying drawings wherein are set forth by way of illustration and example, a certain embodiment of this invention.

Figure 1:
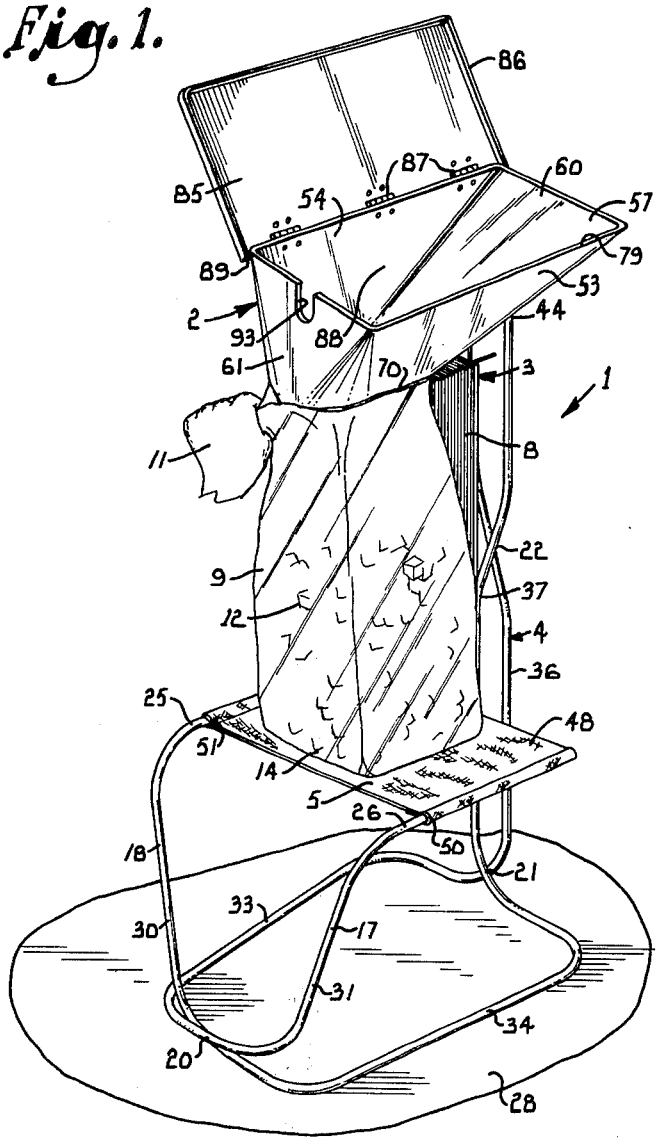
FIG. 1 is a perspective view illustrating a manual ice bagger embodying this invention and including a disembodied hand retaining a bag in position under a material hopper.
Figure 3:
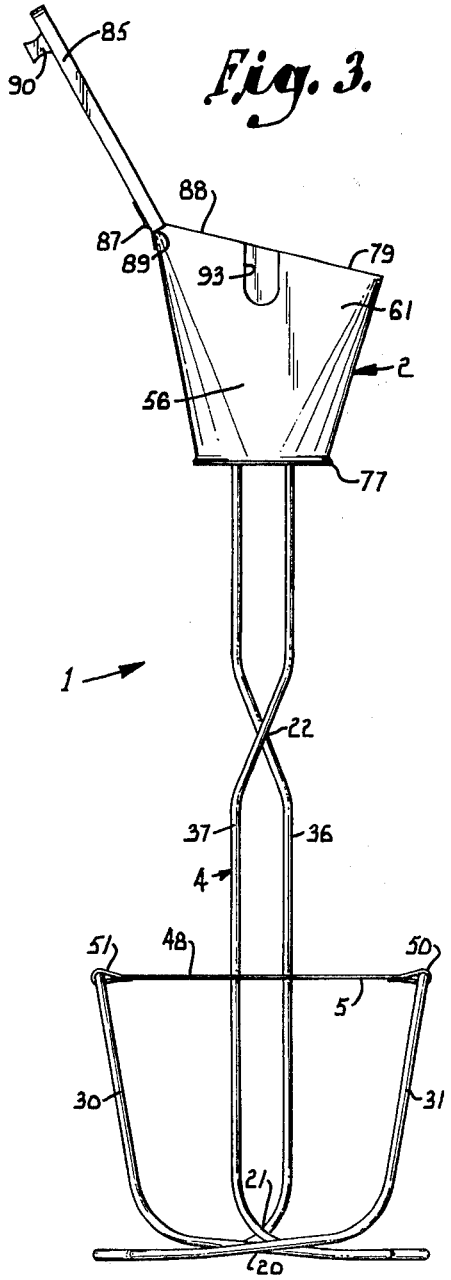
FIG. 3 is a front elevational view of the ice bagger with bags detached therefrom for purposes of clarity.

Referring more in detail to the drawings:

As required, a detailed embodiment of the present invention is disclosed herein, however, it is to be understood that the disclosed embodiment is merely exemplary of the invention which may be embodied in various forms. Therefore, specific functional and structural details disclosed herein are not to be interpreted as limiting, but merely as a basis for the claim and as a representative basis for teaching one skilled in the art to variously employ the present invention in virtually any appropriately detailed structure.

The reference numeral 1 generally indicates a manual ice bagger embodying the present invention, comprising a material directing hopper 2, a bag retaining assembly 3, an upright stand 4, and a bag supporting means 5.

FIG. 1 illustrates the manual ice bagger 1 having a plurality of bags 8 detachably connected to the bag retaining assembly 3. A forwardmost bag 9 has been moved into a material receiving position under the hopper 2, and is retained therein by the hand 11 of the user. Illustrating a particular use of the invention, the bag 9 is filled with a quantity of aggregate ice, in this example ice cubes 12. It is to be understood that other materials can be loaded into the bag 9 using the ice bagger 1 without deviating frm the concept of this invention. As shown herein, the stand 4 retains the hopper 2 in a gravitational loading position relative to the bag 9 connected thereto, enabling material placed in the hopper 2 to fall therethrough and be directed into the bag 9. The stand 4 also supports the bag 9 relative to the hopper 2, holding the bottom 14 of the bag 9 while material, such as the ice cubes 12, is directed thereinto.

The stand 4 in the illustrated example, is a lightweight framework formed from malleable material in the shape of tubing or conduit. The material is sufficiently strong to withstand the shear and bending forces applied thereto, such as steel, aluminum, or the like. Accordingly, the tubing has a relatively thin wall 16, FIG. 5, to facilitate lightweight construction. The wall 16 is also sufficiently thick to be consistant with the strength requirements of the stand 4. As illustrated, conduit sections 17 and 18 are provided which are contortedly bent and bowed in precise relationships and joined together, as by means such as fasteners or welding, at points 20, 21 and 22 to provide a sturdy and resilient frame. The stand 4 has a pair of opposingly positioned and separated arms 25 and 26 which are positioned above and parallel to a floor 28. The arms 25 and 26 are resilient and compressible each toward the other for purposes which will be set forth hereinbelow.

The arms 25 and 26 curve downwardly toward the floor 28 in a right angle turn, forming leg portions 30 and 31 which converge and cross at a joined point 20. The leg portions 30 and 31 then extend into basal portions 33 and 34 which form a generally rectangularly shaped base lying flat upon the floor 28 and positioned under the arms 25 and 26. The basal portions 33 and 34 are spaced apart a substantial distance for secure support of the hopper 2. In the illustrated example, the basal portions 33 and 34 converge rearwardly and cross at a joined point 21 to close the rectangular pattern of the base, and then extend upwardly in a right angle curve into a pair of relatively closely spaced, parallel, upright portions 36 and 37. The upright portions 36 and 37 extend upwardly beyond the arms 25 and 26 a predetermined distance and in a parallel fashion, and support the hopper 2 thereabove. Imparting strength and rigidity, the upright portions 36 and 37 cross and are joined at a mid-longitudinally located point 22. The upright portions 36 and 37 continue upwardly in closely spaced, parallel relationship and terminate in the form of parallel pin portions 40 and 41. The pin portions 40 and 41 are positioned with respect to the upright portions 36 and 37 at obtuse angles 44 and 45 of approximately 135° which direct the pin portions 40 and 41 rearwardly and away from the arms 25 and 26.

As illustrated, the upright portions 36 and 37 and the pin portions 40 and 41 form generally vertically extending upper hanger members which retain the hopper 2 a selected and predetermined distance above the floor 28 and above the horizontal plane of the arms 25 and 26. In the embodiment shown in FIG. 1, a bag supporting means 5 comprising a seat member 48 extends between the arms 25 and 26, and the hopper 2 is so positioned by the stand 4 that materials deposited in the hopper are directed toward the center of the seat member 48.

The seat member 48 is preferably flexible and can be constructed of various kinds of fiber woven cloth, and is preferrably formed of a smooth surfaced synthetic material which is easily disenfected with suitable solutions and provides few gathering places for microrganisms. The synthetic thermoplastic polyester resins, such as polyvinyl chloride (PVC), have proven to be most satisfactory for this purpose. The illustrated seat member 48 comprises a rectangular portion of the synthetic material, and has smooth surfaces on both sides thereof. Engagement portions, shown as loops 50 and 51, are fashioned, using conventional method such as sewing or bonding from opposed ends of the seat member 48. The length of the seat member 48 is slightly less than the distance separating the arms 25 and 26, necessitating that the resilient arms 25 and 26 be slightly compressed laterally and toward each other in order to fit the seat member 48 thereon. The loops 50 and 51 are slid over the free ends of the arms 25 and 26 so that the seat member 48 is taut thereon and resiliently retained connected to the stand 4. The seat member 48 is easily detached from the stand 4 by reversing the above procedure.

Figure 2:
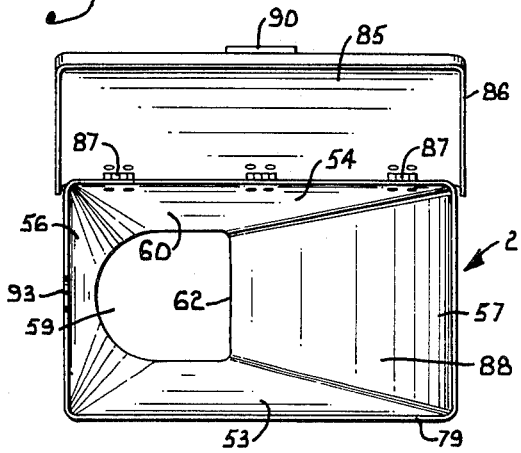
FIG. 2 is an enlarged top plan view of the hopper detached from the remainder of the ice bagger and showing the interior thereof.
Figure 4:
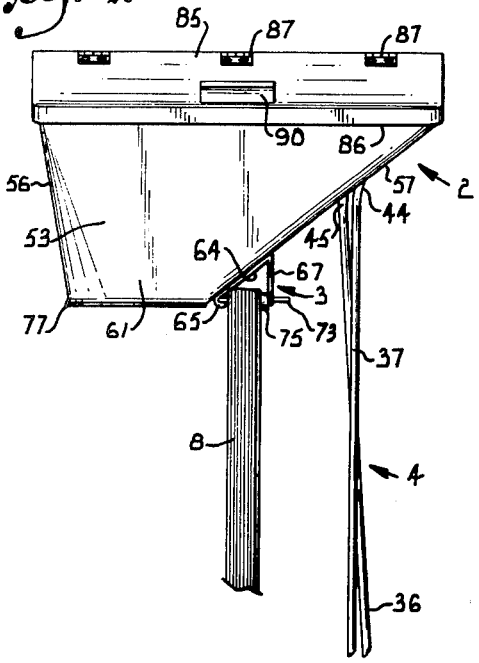
FIG. 4 is an enlarged fragmentary side elevational view of the ice bagger particularly showing a bag retaining clip portion thereof.
Figure 5:
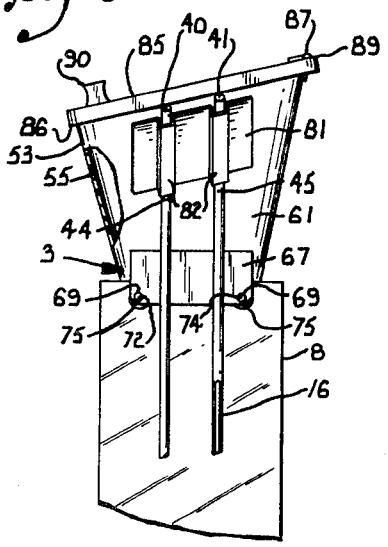
FIG. 5 is an enlarged fragmentary rear elevational view of the ice bagger.

When connected with the stand 4, the hopper 2 is positioned substantially above and aligned with the approximate center of the bag supporting means 5. The hopper 2 is a material-contacting section of the ice bagger 1 and is preferably constructed of such designs and materials that there are minimal corners or crevices for unhealthful microrganisms to collect and which can easily disenfected as needed to insure cleanliness. Such materials are preferably the easily molded synthetic thermoplastic resins such as polyvinyl chloride (PVC), polypropylene, phenoxies, and ABS. The hopper 2 is constructed to be relatively light in weight yet durable and has appropriately sized walls 55, FIG. 5. The hopper 2, when viewed from above, FIG. 2, is generally rectangular in shape and has elongated sidewalls 53 and 54 and endwalls 56 and 57, all of which flowingly converge toward an outlet aperture 59. The outlet 59 has a generally semi-circular shape with a straight edge 62 adjoining the endwall 57. Together, the sidewalls 53 and 54 and the endwalls 56 and 57 form a smooth interior surface 60 which is notably free from all crevices, cracks, or holes which might harbor dirt, mold, or other undesirable material. The hopper 2 has a funnel-like form wherein the inlet end is substantially larger than the outlet end, and functions as such to direct materials into a container. As best illustrated in FIG. 5, the front sidewall 53 is substantially shorter than the rear sidewall 54 to facilitate rapid bagging.

The hopper 2 includes an outwardly extending flange 77 disposed adjacent the hopper outlet aperture 59 to facilitate connecting the bags 8 to the hopper. The flange 77 forms a retainer ledge or lip which is adapted for securely retaining a forwardmost bag 9 thereon in an open, material receiving position under the outlet aperture 59. The marginal dimension of the outermost portion of the flange 77 is substantially less than the open end of the bag 8 to facilitate rapid deployment of the bag around the flange. In the illustrated structure, the flange 77 is formed integrally with the hopper lower end and is continuous thereabout, and curves arcuately outwardly thereof along a normally, substantially horizontal plane.

The illustrated bag retaining assembly 3 comprises a bracket in the shape of an inverted Vee secured on one side 64 to the exterior surface 61 of the endwall 57 and adjacent the outlet edge 62. The free end of the side 64 is formed upwardly to form a generally arcuately shaped receptacle 65 for purposes described hereinbelow. The other side 67 of the bracket is vertically aligned and terminates horizontally opposite the receptacle 65. At the opposite corners of the free edge of the side 67 are a pair of spaced apart, transversely oriented bores 69.

A connector bracket 81 is secured to the exterior surface 61 of the hopper end wall 57 between the bag retaining assembly 3 and the upper hopper edge or rim 79. The connector bracket 81 detachably connects the hopper 2 to the stand 4, and in the illustrated example, comprises a planar member having a pair of parallel, spaced apart channels 82 formed therein which are oriented longitudinally along the hopper end wall 57. The channels 82 are sized to telescopically receive the pin portions 40 and 41 of the stand 4 therein, and in the illustrated structure have a substantially rectangular shape. The conductor bracket 41 is rigidly attached to the hopper end wall 57 by means such as fasteners, or preferably bonding, ultrasonic welding, or other similar means which will not interfer with the smooth inner surface of the hopper. The bracket channels 82 are slidingly and telescopically inserted over the pin portions 40 and 41 and engage the curved portions 44 and 45 of the stand legs and frictionally retain the hopper thereon and maintain the hopper in a substantially horizontal orientation. The hopper 2 can be likewise easily removed from the stand 4 for removal and periodic washing in a disinfectant solution by reversing the above described procedure.

The hopper 2 has a lid or cover 85 which prevents dirt or other foreign matter from impinging and collecting on the interior surface 60 when the ice bagger 1 is stored. In the illustrated example, the cover 85 is a rectangular, generally planar member which is slightly larger in area than the inlet or open top 88 of the hopper 2. The cover 85 is pivotally secured to the upper portion of the sidewall 54 by a plurality of hinges 87. A downwardly turned peripheral edge 86 extends around the cover 85 on the front and sides thereof to protectively fit over and engage the rim 79 when the cover 85 is swung into position. An imperorate block-like handle 90 projects from the upper surface of the cover 85 as an aid for grasping and rotating the cover 85. The handle 90 likewise has no recesses or crevices to harbor possibly harmful dirt or microrganisms.

The cover 85 includes a stop which selectively retains the same in an open position, wherein the cover 85 assumes an obtuse angle with respect to the hopper inlet end 88 for guiding the material into the hopper. In this example, the rearward edge of the cover top panel 85 extends outwardly of the hinges 87, and an associated portion of the hopper exterior surface 61 lies in the rotational path of the cover rearward edge and engages the same to retain the lid at an angle in the nature of 45° past vertical to aid in scooping the material into the hopper 2.

The hopper 2 also includes means for storing a scoop 91 in the hopper cavity when the ice bagger device is not in use. In this example, the hopper end wall 56 includes a U-shaped aperture 93 extending from the upper rim thereof centrally between the hopper side walls 53 and 54. The aperture 93 is sufficiently deep for a handle portion 92 of the scoop 91 to extend therethrough and while the main portion of the scoop 91 lies longitudinally within the interior of the hopper 2 and is abuttingly supported thereby. When the scoop 91 is in the above noted storage position, the cover 85 can be closed thereby protecting both the interior of the hopper and the scoop from foreign materials impinging and/or accumulating thereon.

The bags 8 are preferably arranged in a layered or overlying manner, and are suspended by the bag retaining assembly 3. Each of the bags 8 has a closed bottom end 14 and an open upper end 15 and is preferably constructed of a transparent synthetic material. The illustrated bags include a free edge 70 arranged on the forward side of the device and a tongue member 71 which extends upwardly a predetermined distance from the free edge 70. The bag tongue portion 71 includes a pair of spaced apart apertures 76 and 78 which extend transversely through the same, and are adapted to receive therethrough means for suspending the bags from the hopper.

A clip 73 is provided for detachably connecting each of the bags 8 to the hopper. In the illustrated example, the clip 73 comprises a U-shaped staple having a pair of rigid parallel legs 72 and 74 adapted for threading through the mating apertures 76 and 78 in the upper tongue portion of each bag, and a laterally extending cross-member (not shown) which interconnects the staple legs. The staple legs 72 and 74 are shaped for being received through the apertures 76 and 78 in the tongue portion of the bag, as well as the mating apertures 69 in the rearward portion 67 of the bracket. The cross-member of the staple is preferably integrally formed with the legs 72 and 74 and is adapted for engagement with the arcuately shaped portion 65 of the bracket.

The bags 8 are preferably grouped together in selected weight and size classes and are retained on an associated clip 73 by a pair of grommets or washers 75 which have an outside diameter enlarged from that of the diameter of the bag apertures 76 and 78, and an inside diameter slightly smaller than that of the staple legs 72 and 74 and are frictionally retained thereon. The bags 8 are longitudinally slideable on the staple legs 72 and 74, and the grommets 75 prevent the bags from inadvertently coming off the free ends of the staple legs when the clip 73 is not attached to the ice bagging device.

In operation, the manual ice bagging device is positioned adjacent to an ice receptacle (not shown) from which the ice is to be loaded into the individual bags. As previously noted, the illustrated structure is particularly adapted for use by right-handed users, however, it is to be understood that a model for left-handed users can be simply adapted by reversing the design of the hopper and stand. In the illustrated structure, the right-handed user will stand facing the forward portion of the hopper, with his right hand oriented toward the bulk ice receptacle or maker. The user initially positions the ice bagging device within arm's reach of the receptacle, then grasps the free edge 70 of the forwardmost bag 9 and pulls the same outwardly over the flange 77. As previously noted, the marginal dimension of the bag 9 is slightly greater than that of the flange 77 to facilitate easy positioning of the bag around the flange. The user then grasps the excess bag material in his left hand and twists the same, thereby gathering the excess material and pulling the bag free edge 70 taut about the hopper flange 77 and retaining the same securely around the outlet aperture 59. The bag 9 is stretched slightly between the bracket portion 65 and around the hopper flange 77 and thereby securely retains the bag in position. The user then grasps the scoop 91 in his right hand and shovels the ice from the ice making machine or other material depository. The slant of the hopper rim 79 facilitates quickly tossing the ice into the hopper. Further, the cover 85 in its upraised and inclined position deflects misdirected ice into the hopper that would otherwise be spilled onto the floor and wasted. Hence, the operator can quickly scoop aggregate ice from the receptacle in a single motion and efficiently direct same into the hopper and fill the bag 9. Not only does the present device allow the user to fill more bags in less time, but is also presents the consequent advantage that there is less ice meltage during the bagging operation thereby representing an energy savings, and furthermore, providing higher quality ice which is not refrozen into a large piece which in turn must be picked or broken apart. After the bag 9 is full, the user simply releases his grip on the bag free edge 70, grasps the bag 9, rips the tongue portion 71 of the bag 9 from the staple legs 72 and 74, and pulls the bag 9 out from under the hopper 2. The open end of the bag is then closed in a conventional manner such as wire rings or the like. The bagged ice is then returned to a freezer area for sale and/or storage. Because the bags 8 are slidably mounted on the staple legs 72 and 74, the same are pulled forwardly and sequentially unfolded around the hopper flange 77 for individually filling each of the bags 8 in a sanitary manner.

Figure 6:
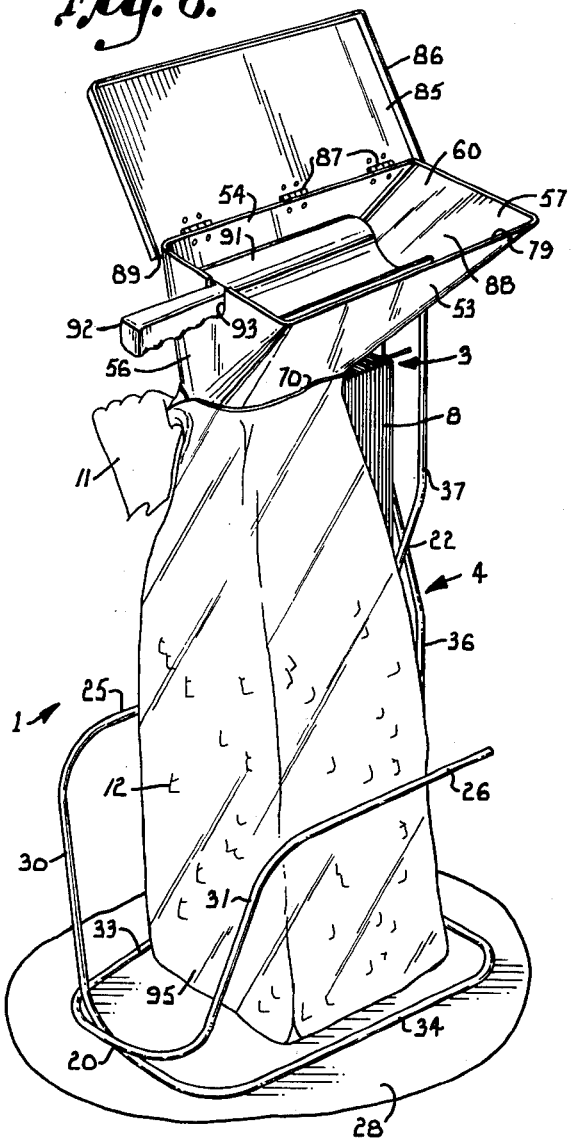
FIG. 6 is a perspective view of the ice bagger adapted for use with a larger bag.
Figure 7:
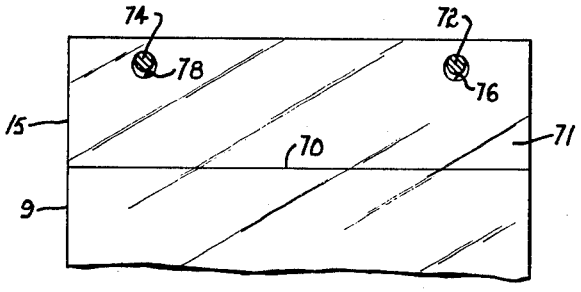
FIG. 7 is a fragmentary front elevational view of a bag and bag retaining staple used in connection with the ice bagger.

As best illustrated in FIGS. 1 and 6, the present invention is adapted to accomodate variously sized bags. Bags for ice are typically prepared and sold in different sizes, for example, 5, 10, 20, 30, 40 and 50 pound bags. Variously sized bags can be used with the present invention by varying the distance between the outlet aperture 59 of the hopper 2 and the bag supporting seat 48. For example, in FIG. 1, the ice bagger 1 is arranged to accomodate the filling of ten pound bags of ice, with the seat portion 48 mounted on the associated frame arms 25 and 26. To fill fifty pound bags, as shown in FIG. 6, the seat 48 may be completely removed, whereby the bottom of the bag 95 rests against and is supported by the floor surface 28. For intermediately sized bags, the user is provided with a plurality of seat members 48 each having a different length for supporting a commensurately sized bag.

It is to be understood that the length of the frame members 30 and 31 may be adjusted to accomodate virtually any size of bag, including bags of five pounds and less.

After the bagging operation has been completed, the user positions the scoop 91 within the hopper cavity as shown in FIG. 6, and the cover member 85 is closed over the hopper rim 79, hence both the hopper and the scoop 91 are protected from foreign material which might light thereon. Also, since the bags are hung in a folded, vertical orientation by the staple, they are similarly stored in a sanitary fashion.

It is to be understood that while one form of this invention has been illustrated and described, it is not to be limited to the specific form or arrangement of parts herein described and shown except insofar as such limitations are included in the following claims.

What is claimed and desired to secure by Letters Patent is:

1. A manual bagging device comprising:
(a) a hopper having an inlet end for receiving material therethrough, and an outlet end for directing said material into a commensurately shaped bag;
(b) a stand connected with said hopper and supporting the hopper above a floor surface;
(c) means operably connected with said stand for supporting said bag directly below the outlet end of said hopper, and comprising a pair of arm members connected with a lower portion of said stand and positioned below said hopper outlet end in spaced relation on opposing sides thereof, and a flexible bag support having opposing edges thereof connected with an associated one of said arm members, and extending tautly therebetween; and
(d) bag retaining means connected to said hopper and shaped for detachably suspending a plurality of said bags thereon and positioning said bags adjacent said hopper outlet end for sequentially unfolding said bags into an open material receiving position about said hopper outlet end for individually filling each of said bags.

2. A bagging device as set forth in claim 1 wherein:
(a) said bag support opposing edges each has a loop therein shaped to slide over a free end of the associated arm member for detachably connecting the bag support to the stand to facilitate the filling of variously sized bags.

3. A bagging device as set forth in claim 2 wherein:
(a) said hopper includes an outwardly extending flange disposed adjacent to said hopper outlet end; and
(b) each bag has a free edge with a perimeter larger than said hopper flange, whereby the bag free edge is positioned over said hopper flange and manually twisted to tighten the bag thereon to securely connect the bag to the hopper during bag filling, and permit quick separation of the bag from the hopper after the bag is filled.

4. A bagging device as set forth in claim 2 wherein:
(a) said bags each have a free edge and a tongue portion projecting outwardly of the free edge; said tongue portion having first and second apertures therethrough; and
(b) said bag retaining means comprises a U-shaped staple having a pair of rigid parallel legs threaded through the first and second aperture respectively of each of said bags, and a laterally extending cross member interconnecting said staple legs and detachably connecting the staple to said hopper.

5. A manual ice bagging device comprising:
(a) a hopper having an inlet end for receiving aggregate ice therethrough, and an outlet end for directing said ice into a commensurately shaped bag;
(b) a stand connected with said hopper and supporting the hopper above a floor surface;
(c) means operably connected with said stand for supporting said bag directly below the outlet end of said hopper and comprising a pair of arm members connected with a lower portion of said stand and positioned below said hopper outlet end in spaced relation on opposing sides thereof, and a flexible bag support having opposing edges thereof connected with an associated one of said arm members, and extending tautly therebetween; and
(d) a bag retaining clip connected to said hopper and shaped for detachably suspending a plurality of said bags by an upper end of each on said clip and positioning said bags adjacent said hopper outlet end for sequentially unfolding said bags into an open material receiving position about said hopper outlet end for individually filling each bag in a sanitary manner.

6. An ice bagging device as set forth in claim 5 wherein:
(a) said clip comprises a U-shaped staple having a pair of rigid parallel legs adapted for threading through mating apertures in the upper end of each bag, and a laterally extending cross member interconnecting said staple legs; and including
(b) a bracket connected with said hopper adjacent the outlet end thereof and having portions engaging the staple legs and cross member for detachably connecting said staple to said hopper.

7. A manual bagging device comprising:
(a) a hopper having an inlet end for receiving material therethrough and an outlet end having an outwardly extending flange;
(b) a stand connected with said hopper and supporting the hopper above a floor surface;

(c) a plurality of material receiving bags each having an upper end, a bottom, and an open edge shaped commensurately with said hopper outlet end flange;

(d) a bag retaining clip detachably connected to said hopper; said bags being suspended from said clip and longitudinally movable thereon; said clip positioning said bags adjacent the outlet end of the hopper, whereby said bags are sequentially unfolded into an open position with the bag open edge about said flange and selectively retained tautly thereover for individually filling each of said bags;

(e) means for supporting the bottom of the bags during said open position, and comprising a pair of arm members connected with a lower portion of said stand and being positioned below said hopper outlet end in spaced relation on opposing sides thereof; and (f) a flexible bag support having opposing edges thereof connected with an associated one of said arm members and extending tautly therebetween, and abuttingly and sequentially supporting the bottom of said bags during the open position thereof.

8. A bagging device as set forth in claim 7 including:

(a) a lid hingedly attached to said hopper and operative to close said hopper inlet end and prevent foreign materials from entering the hopper through the inlet end.

9. A bagging device as set forth in claim 8 wherein:

(a) said lid includes a stop which selectively retains said lid in an open position wherein said lid assumes an obtuse angle with respect to the hopper inlet end for guiding the material into said hopper.

10. A manual ice bagging device comprising:

(a) a hopper having an inlet end for receiving aggregate ice therethrough, and an outlet end for directing said ice into a commensurately shaped bag;

(b) a lid hingedly attached to said hopper and operative to close said hopper inlet end and prevent foreign material from entering the hopper through the inlet end; said lid including a stop which selectively retains said lid in an open position wherein said lid assumes an obtuse angle with respect to the hopper inlet end for guiding overthrown aggregate ice into said hopper;

(c) a stand connected with said hopper and supporting the hopper above a floor surface;

(d) means operably connected with said stand for supporting said bag directly below the outlet end of said hopper; and (e) a bag retaining clip connected to said hopper and detachably suspending a plurality of said bags by an upper end of each on said clip and positioning said bags adjacent said hopper outlet end for sequentially unfolding said bags into an open material receiving position about said hopper outlet end for individually filling each bag in a sanitary manner;

(f) a scoop having a main portion thereof shaped to retain the aggregate ice therein, and a handle portion thereof rigidly connected with said main portion and extending generally longitudinally thereof; and wherein (g) said hopper has front, rear, and side walls which are shaped to mate with and abuttingly support the main portion of the scoop; and (h) one of said hopper side walls includes a U-shaped aperture extending through the inlet end thereof, and receives the handle portion of said scoop therethrough, whereby said scoop is bodily retained wholly within said hopper for sanitary storage of said scoop.

11. An ice bagging device as set forth in claim 10 wherein:

(a) said lid is hingedly attached to the rear wall of said hopper; and (b) said hopper inlet end is inclined downwardly from said rear wall to said front wall to facilitate quick filling of said bags.

* * * * *